US005938095A

United States Patent [19]

Haar et al.

[11] Patent Number: 5,938,095

[45] Date of Patent: Aug. 17, 1999

[54] WATERPROOF CARRYING BAG FOR RAFTERS AND THE LIKE

[75] Inventors: James M. Haar; Charles P. Hall, both of Santa Rosa, Calif.

[73] Assignee: Stearns, Inc., St. Cloud, Minn.; by said Charles P. Hall

[21] Appl. No.: 08/056,188

[22] Filed: May 3, 1993

[51] Int. Cl.[6] ..... A45F 3/02

[52] U.S. Cl. ..... 224/600; 224/235

[58] Field of Search ..... 224/202, 148, 224/205, 235, 252, 148.1, 600; 206/811; 200/302.3, 302.2

[56] References Cited

U.S. PATENT DOCUMENTS

| | | | |
|---|---|---|---|
| 1,328,988 | 1/1920 | Eckert et al. | 206/811 X |
| 3,042,796 | 7/1962 | De Forest | 206/811 X |
| 3,830,270 | 8/1974 | Hagert et al. | 224/205 |
| 3,935,607 | 2/1976 | Cantwell et al. | 114/345 |
| 4,144,607 | 3/1979 | Soubie | 224/148 X |
| 4,155,453 | 5/1979 | Ono | 206/811 X |
| 4,398,074 | 8/1983 | Danielson et al. | 200/302.2 |
| 4,766,837 | 8/1988 | Parish | 114/311 |
| 5,234,144 | 8/1993 | Iler | 224/202 X |

OTHER PUBLICATIONS

Flyer for Seasafe #4055 by Basic Designs, Inc. –offered for sale Aug. 1991.

*Primary Examiner*—Renee S. Luebke

*Attorney, Agent, or Firm*—Flehr Hohbach Test Albritton & Herbert

[57] ABSTRACT

A waterproof carrying bag having a flexible, liquid impervious body portion with an internal storage cavity and a substantially rigid neck portion having an inner surface defining an opening into the container. A closure seats on the neck portion, covering the opening. The closure has a sealing gasket which is compressed between the closure and the neck portion when the closure is seated on the neck, substantially preventing the passage of moisture between the closure and neck portion.

5 Claims, 3 Drawing Sheets

WATERPROOF CARRYING BAG FOR RAFTERS AND THE LIKE

This invention pertains generally to carrying bags and, more particularly, to a waterproof carrying bag which is particularly suitable for use by rafters and the like.

Carrying bags which protect the contents of the bag against water damage have commonly been provided by bags which use, for example, a zipper-type closure, complementary pieces of hook and loop materials, or clips to close and substantially seal the bag. Recently, another type of waterproof carrying bag was provided by Basic Designs, Inc., Santa Rosa, Calif. The carrying bag is sealed by a cap which is screwed onto a rigid neck.

It is, in general, an object of the present invention to provide a new and improved waterproof carrying bag.

Another object of the present invention is to provide a waterproof carrying bag of the above character which overcomes the limitations and disadvantages of the carrying bags which have been used for rafting, boating and the like.

These and other objects are achieved in accordance with the invention by providing a waterproof carrying bag having a flexible liquid impervious body portion with an internal storage cavity and a substantially rigid neck portion having an inner surface defining an opening into the container. A closure seats on the neck portion, covering the opening. The closure has a sealing gasket which is compressed between the closure and the neck portion when the closure is seated on the neck. The gasket substantially prevents the passage of moisture between the closure and neck portion, protecting the contents of the bag from water damage.

Figure 1:
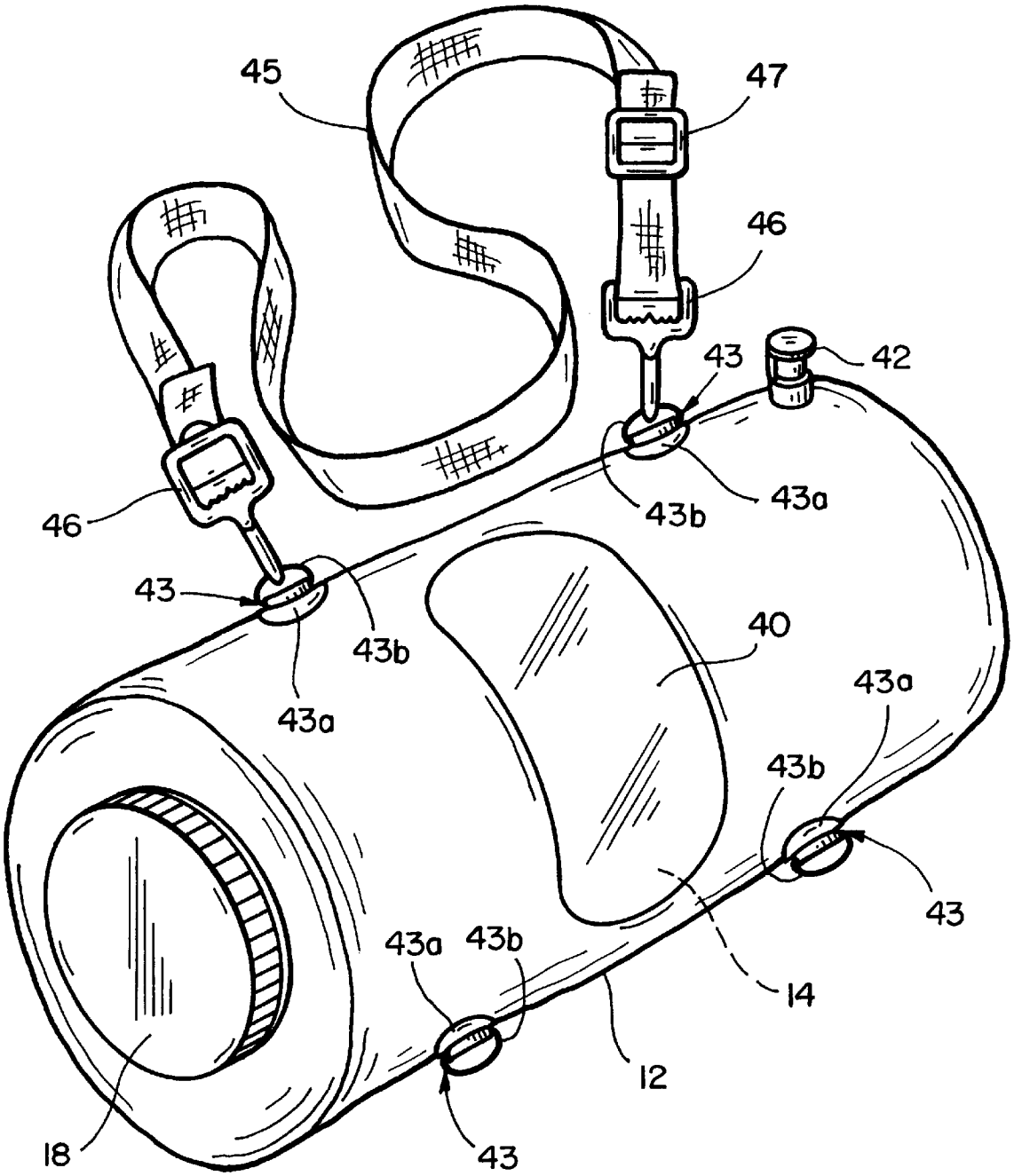
FIG. 1 is a perspective view of one embodiment of a carrying bag according to the invention.
Figure 2:
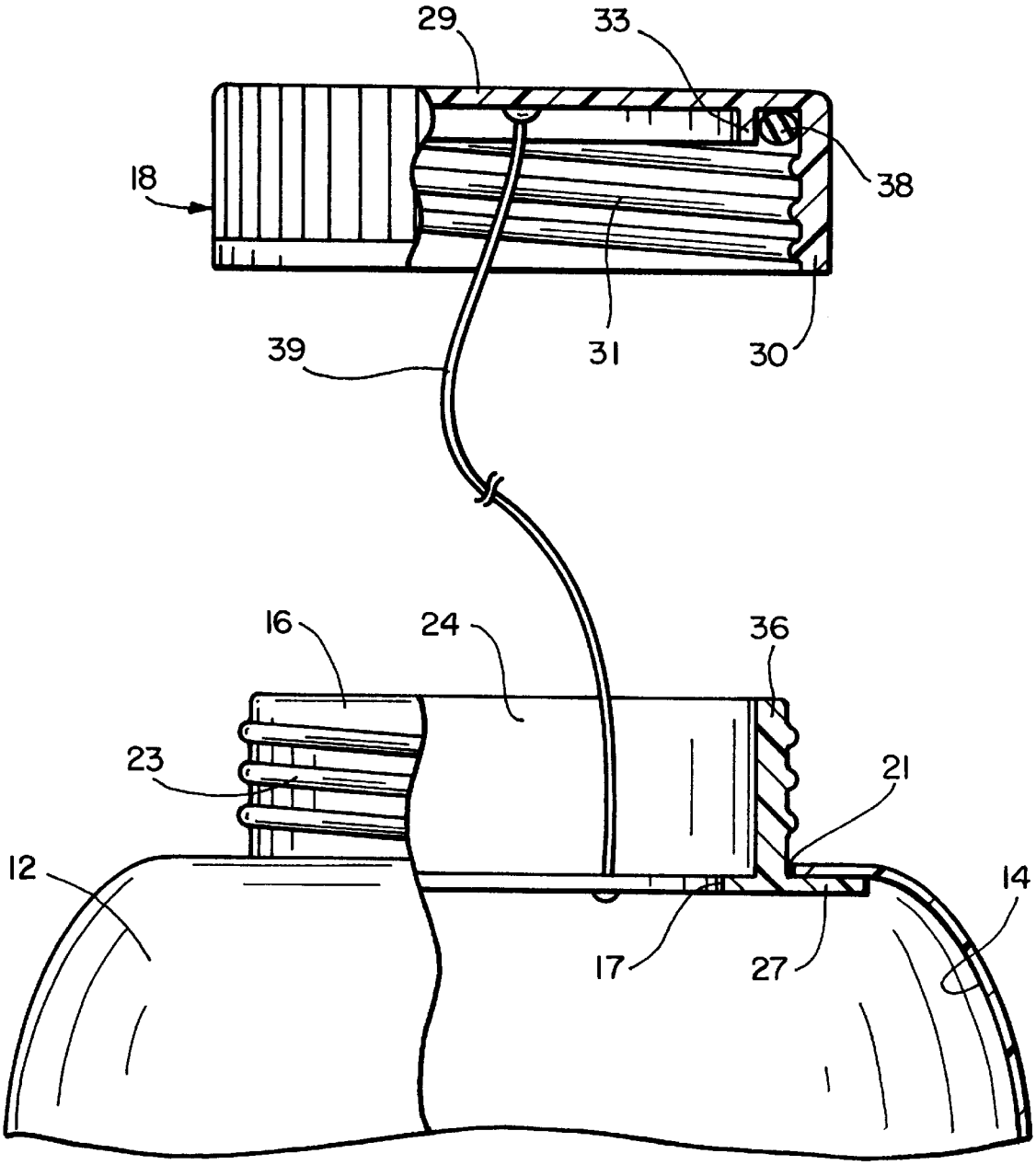
FIG. 2 is a side elevational view of a closure and a neck portion of the carrying bag of FIG. 1, shown partially in cross section.

As illustrated in the drawings, the waterproof carrying bag has a body portion 12 and a neck portion 16, with an internal storage cavity 14 inside the body portion. Access to the storage cavity is provided through an opening 17 in the neck portion. Various items, such as a radio, camera, clothing, navigating equipment, etc., may be passed through the opening and into the cavity 14 for storage. In the presently preferred embodiment, the size of the storage cavity is on the order of 250 to 6000 cubic inches. A closure or cap 18 fits onto the neck portion 16, covering the opening 17 to secure the bag contents within the storage cavity.

The body portion 12 is fabricated of a material impervious to water and other liquids. Examples of suitable materials include flexible polyvinylchloride (PVC) sheet, polyurethane, and woven materials such as nylon and rayon which have been coated with vinyl, urethane, or another waterproof material. The flexibility of the material offers several advantages including the ability to partially collapse the body portion when the storage cavity is not filled to capacity. A carrying bag occupying minimal space beyond the actual size of the stored items is particularly useful when the available storage space is limited, such as on rafts, kayaks, canoes and the like.

In the embodiment illustrated, neck portion 16 comprises a collar which passes through an aperture 21 formed in the body portion. The collar has a threaded outer peripheral surface 23, an inner surface 24 surrounding the opening 17 to the storage cavity and an annular mounting flange 27. The inner periphery of flange 27 defines the size of the opening 17. In the embodiment illustrated, the collar will deform slightly, allowing items having a width slightly larger than the diameter of opening 17 to be passed through the opening and into the cavity 14. In one presently preferred embodiment, the opening 17 is approximately 3.75 inches; however, an opening on the order of 3 to 10 inches would be desirable. The collar 16 is secured to the body portion 12 along the upper surface of the mounting flange 27. The seam between the flange and the body portion is sealed to prevent any water from seeping into the carrying bag and damaging the contents held in the cavity 14. The collar may be fabricated of any suitable material, such as a semi-rigid plastic; however, a material which may be ultrasonically welded or otherwise bonded to the body portion is preferred. Welding the collar 16 to the body portion 12 efficiently produces a watertight seal between the collar and body portion.

The cap 18 mates with the collar 16, closing the storage cavity 14. The cap has a top portion 29 covering the opening and an annular skirt portion 30 having a threaded inner surface 31. The threaded surface 31 of the cap mates with the threaded outer surface 23 to secure the closure 18 on the collar 16. An inner flange 33 depends from the underside of the top portion 29 of the cap. When the closure is twisted onto the container, the inner flange fits within the opening 17. A resilient gasket 38 is retained between the inner flange 33 and the inner surface 31 of the skirt portion.

When the closure 18 is screwed onto the collar, the gasket is compressed between the cap and the rim portion 36 of the collar, forming a seal. The seal produced by the gasket prevents water and other liquids from leaking between the closure 18 and the collar 16 and into the storage cavity. The seal is broken by removing the cap from the neck portion 16. The opening 17 may be conveniently resealed by twisting the cap onto the neck portion. In the embodiment illustrated, the gasket is an O-ring fabricated of a resilient material impervious to liquid. The closure may be fabricated of PVC, polypropylene, or any other suitable material.

The carrying bag has a tether 39 coupling the closure 18 to the neck portion 16. The tether has one end secured to the underside of the top 29 and the other end attached to the inner surface of the collar 16. The tether is retained inside the carrying bag when the cap is seated on the collar. When the cap is removed, the tether 39 holds the cap 18 and prevents it from becoming separated from the body portion and misplaced.

In the embodiment illustrated, the body portion 12 has a window 40 through which at least a portion of the contents of storage cavity 14 may be viewed without removing the cap and breaking the seal between the cap interior of the collar 16. Partially displaying the bag contents through the window 40 is particularly useful when several similar carrying bags are used. The window may be fabricated of any suitable transparent material impervious to water, such as clear PVC sheet. The window is secured to the body portion 12 by welding or by other means providing a watertight seal.

In one presently preferred embodiment, the body portion 12 has a valve 42 through which the bag can be inflated after the cap has been secured on the collar. When inflated, the bag will float for at least a brief period of time if it is dropped in the water. The rafter, canoer, or kayaker, for example, will be able to easily retrieve the floating bag and recover its contents. Since the bag is watertight, the contents retained within the storage cavity 14 will remain dry and will be protected from water damage.

In the embodiment illustrated, the carrying bag has a number of grommets 43 secured to the body portion 12 and a removable strap 45. As illustrated in FIG. 1, each of the grommets has a relatively thin flat circular base 43*a* affixed face-to-face to the outer surface of the cylindrical side wall, and a ring 43*b* to which the strap is attached. The strap has a clip 46 on each end which is coupled to one of the grommets 43 to attach the strap 45 to the body portion 12. The removable strap also has a buckle 47 which may be used to adjust the strap length. An individual may use the strap to conveniently carry the bag or, if desired, the strap may be removed by disengaging the clips 46 from the grommets 43. Other accessories, such as a compass, identification tag, etc., may also be attached to the grommets 43.

Figure 3:
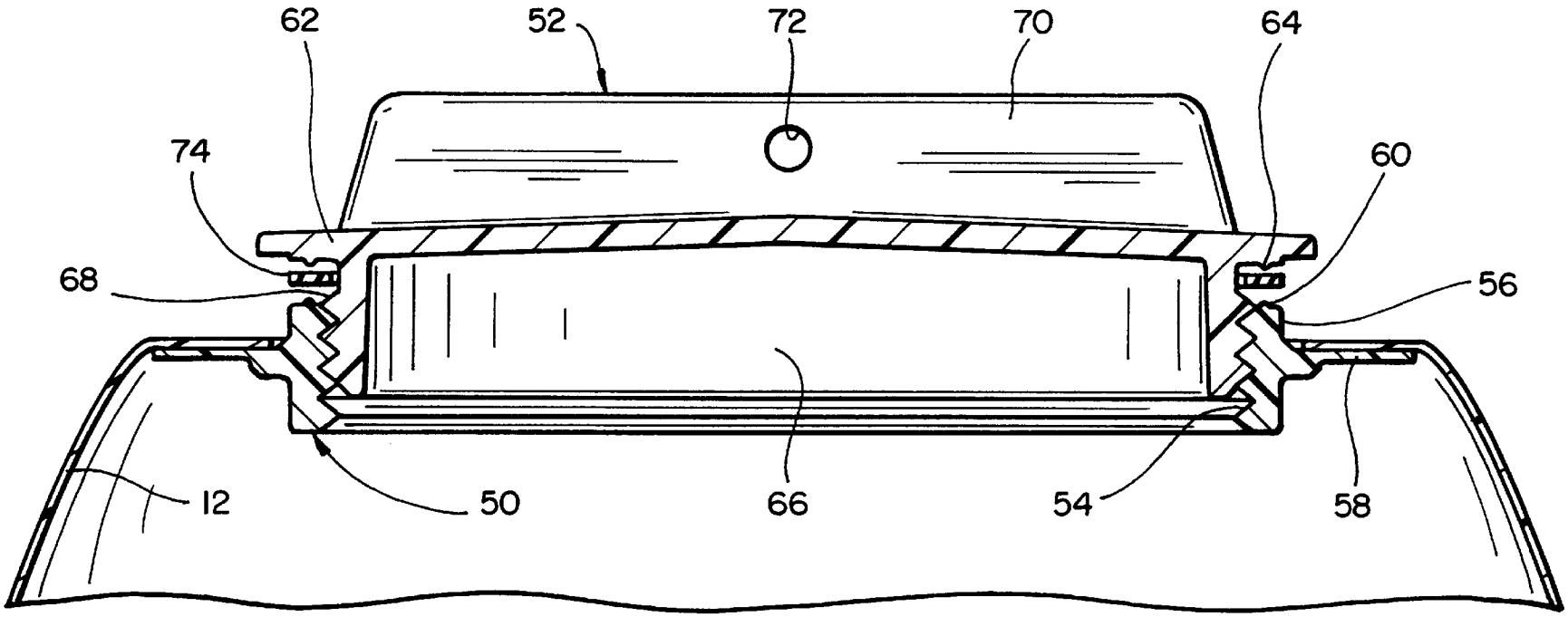
FIG. 3 is a cross sectional view of another embodiment of a closure and neck portion of a carrying bag according to the invention.

Another embodiment of the waterproof carrying bag, shown in FIG. 3, has a collar 50 and a cap 52 which mates with the collar to cover the neck opening and secure the contents within the storage cavity. The collar 50 has a threaded inner surface 54 defining the size of the neck opening, an outer surface 56 and an annular mounting flange 58. A sealing surface 60 is formed on the rim of the collar. The collar is affixed to the body portion 12 by ultrasonic welding or otherwise bonding the material surrounding the opening 21 to the mounting flange 58. A watertight seal is formed between the mounting flange and the body portion to prevent any water or other moisture from leaking between the collar and body portion and into the storage cavity. The collar 50 may be fabricated of any suitable material, for example a semi-rigid plastic.

The cap 52 has a top wall 62, a skirt portion 66 which is offset inwardly from the periphery of the top wall, and an annular sealing rib 64 on the underside of the top wall between the skirt portion and the periphery of the wall. The skirt portion has a threaded outer surface 68 which mates with the threaded inner surface 54 of the collar. The cap also includes a diametrically extending handle 70 which may be grasped by the user when twisting the cap to open and close the container. A tether 73 (not shown) may be secured through an aperture 72 formed in the handle and to the exterior of the body portion to couple the cap and the body portion together. A resilient gasket 74 surrounds the skirt portion 64. When the cap is twisted onto the container, the gasket is compressed between the rib 64 and sealing surface 60, forming a seal which prevents moisture from leaking into the storage cavity. The closure may be fabricated of polypropylene, PVC or any other suitable material. In the embodiment illustrated, the gasket is an O-ring formed of a resilient material.

The carrying bag has a number of important features and advantages. It is particularly suitable for use when rafting, canoeing or kayaking, for protecting important articles from becoming wet or damaged. The carrying bag is formed of a liquid impervious material. The seams between the body portion and the collar 16 and the window 40 are sealed. When the closure is twisted onto the collar 16, the resilient gasket seals the opening 17 and prevents leakage. The waterproof carrying bag has a watertight storage cavity 14 for safely storing items when rafting, boating or the like. The flexible body portion is easy to load into compact storage areas. The inflation valve is particularly useful for boaters, as it reduces the risk of losing the bag if it falls into the water. The window may be used to conveniently verify the contents of the bag. The tether ensures the cap will not become misplaced. Various accessories may be secured to the grommets on the exterior of the bag.

It is apparent from the foregoing that a new and improved waterproof carrying bag has been provided. While only, certain presently preferred embodiments have been described in detail, as will be apparent to those familiar with the art, certain changes and modifications can be made without departing from the scope of the invention as defined by the following claims.

We claim:

1. In a waterproof carrying bag: a flexible body of water-impervious material having a generally cylindrical side wall and an internal storage cavity, a semi-rigid collar at one end of the body having a laterally deformable neck portion defining an opening which provides access to the internal cavity and can be extended in one lateral dimension by deformation of the neck portion to accommodate an object of greater lateral extent than the unextended opening, a closure member threadedly secured to the neck portion for covering the opening and holding the neck portion in a configuration conforming to the closure member, the closure member comprising a cap having an end wall, an internally threaded peripheral skirt, and an inner flange disposed coaxially of the skirt and extending into the opening when the cap is threaded onto the neck portion, and a sealing gasket carried by the closure member and adapted to provide a water-tight seal between the closure member and the collar when the closure member is threaded onto the neck portion and the neck portion is held in the conforming configuration by the closure member, the sealing gasket being compressed between the end wall, the skirt and the flange by the neck portion.

2. The waterproof carrying bag of claim 1 further including a plurality of grommets affixed to the side wall, each of the grommets having a relatively thin flat circular base affixed face-to-face to the outer surface of the cylindrical side wall and a ring for attachment of objects to the bag, and a carrying strap removably connected to two of the rings.

3. In a waterproof carrying bag: a flexible body of water-impervious material having a generally cylindrical side wall and an internal storage cavity, a semi-rigid collar at one end of the body having a laterally deformable neck portion defining an opening which provides access to the internal cavity and can be extended in one lateral dimension by deformation of the neck portion to accommodate an object of greater lateral extent than the unextended opening, a closure member threadedly secured to the neck portion for covering the opening and holding the neck portion in a configuration conforming to the closure member, the closure member comprising a cap having an end wall, an internally threaded peripheral skirt, and an inner flange disposed coaxially of the skirt and extending into the opening when the cap is threaded onto the neck portion, a sealing gasket carried by the closure member and adapted to provide a water-tight seal between the closure member and the collar when the closure member is threaded onto the neck portion and the neck portion is held in the conforming configuration by the closure member, the sealing gasket being compressed between the end wall, the skirt and the flange by the neck portion, a tether connected to the closure member for retaining the closure member to the body when the closure member is removed from the neck portion, a transparent viewing port in the side wall of the body for visual observation of contents in the internal cavity, a plurality of grommets affixed to the side wall and having rings for attachment of objects to the bag, a carrying strap removably connected to two of the rings, and a valve accessible externally of the bag through which air can be introduced into the cavity to inflate the bag.

4. The waterproof carrying bag of claim 3 wherein each of the grommets has a relatively thin flat circular base affixed face-to-face to the outer surface of the cylindrical side wall.

5. The waterproof carrying bag of claim 3 wherein the storage cavity has a volume of 250 to 6000 cubic inches, and the opening has a diameter of 3.75 to 10 inches.

* * * * *